United States Patent [19]

Krechel

[11] Patent Number: 4,611,447

[45] Date of Patent: Sep. 16, 1986

[54] CURTAIN WALL AND WINDOW FRAME CONSTRUCTION

[75] Inventor: Oliver A. Krechel, St. Louis County, Mo.

[73] Assignee: Profile Systems, Inc., St. Louis, Mo.

[21] Appl. No.: 531,859

[22] Filed: Sep. 14, 1983

[51] Int. Cl.[4] ..... E06B 7/14

[52] U.S. Cl. ..... 52/209; 52/235

[58] Field of Search ..... 52/235, 398, 397, 97, 52/209, 302, 303; 49/DIG. 1

[56] References Cited

U.S. PATENT DOCUMENTS

| | | | |
|---|---|---|---|
| 2,914,145 | 11/1959 | Benson | 52/235 |
| 3,014,560 | 12/1961 | Krauss | 52/397 |
| 3,093,217 | 6/1963 | Doede | 52/397 |
| 3,204,324 | 9/1965 | Nilsen | 49/DIG. 1 |
| 3,443,346 | 5/1969 | Eggert | 52/400 |
| 3,858,375 | 1/1975 | Silvernail | 52/235 |
| 4,128,934 | 12/1978 | Doring | 49/DIG. 1 |
| 4,464,874 | 8/1984 | Shea | 52/398 |
| 4,471,584 | 9/1984 | Dietrich | 52/398 |

FOREIGN PATENT DOCUMENTS

| | | | |
|---|---|---|---|
| 880066 | 9/1971 | Canada | 52/235 |
| 338137 | 3/1904 | France | 52/209 |
| 928105 | 6/1963 | United Kingdom | 52/235 |

*Primary Examiner*—John E. Murtagh

*Attorney, Agent, or Firm*—Paul M. Denk

[57] ABSTRACT

An exterior curtain wall and window construction for a commercial building is disclosed in which the curtain wall and window frames are secured to the framework of the building thereby to constitute the exterior walls of the building with the curtain wall having window openings therein. The window openings are defined by upper and lower window pane securement frames which have portions thereof in abutting engagement with the outer margins of the window pane at the top and bottom thereof. A removable window securement member may be snapped in place into the upper window securement frame with sealing gaskets interposed between the inner and outer faces of the window pane and the window frame members so as to seal the window pane relative to the frames and to cushion the window pane relative to the frame. A weep tube in communication with the inside surface of the window adjacent the bottom thereof is provided so that condensation or other moisture may be drained from the bottom of the window to a location exteriorily of the curtain wall at a location below the window.

8 Claims, 7 Drawing Figures

FIG. 3.
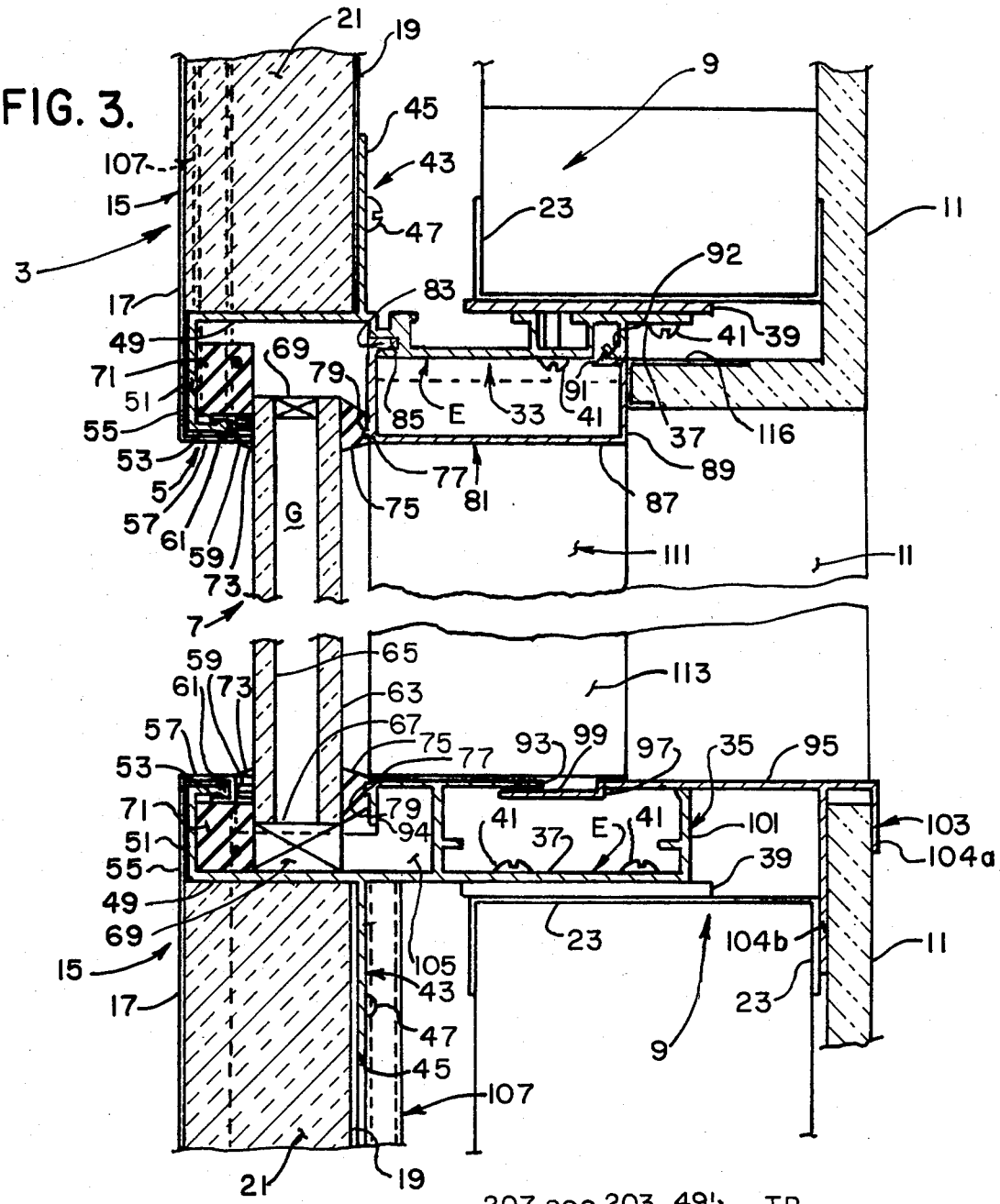
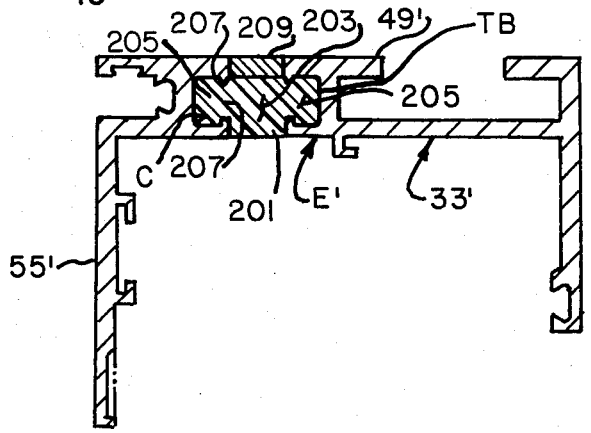
FIG. 3A.

CURTAIN WALL AND WINDOW FRAME CONSTRUCTION

BACKGROUND OF THE INVENTION

This invention relates to a building construction system, and more particularly to a so-called curtain wall and window construction system for a steel or concrete frame office or other commercial buildings.

Oftentimes, commercial buildings, such as office buildings, high rise apartment buildings, hotels, and the like, utilize a skeletal framework of steel or concrete beams. Framing studs are secured to the framework of the building along the exterior portions thereof and so-called curtain walls are secured to this framework so as to constitute the exterior walls and windows of the building. Typically, these curtain walls comprise exterior wall panels having an outer metal sheet which has been treated to give a desired surface finish, an inner metal sheet, and a thermal insulative core between the inner and outer sheets. The exterior wall panels are typically so arranged on the exterior wall of the building as to form window openings therein for receiving glass panels which are oftentimes sealed in place relative to the exterior wall panels. Reference may be made to such as U.S. Pat. Nos. 2,885,040, 3,715,848, 3,319,388, 3,316,681 which show various typical prior art curtain wall constructions.

In recent years, it has become particularly desirable, so as to create a desired aesthetic effect for a building, to have substantially continuous expanses of the exterior walls of large commercial buildings with as little break as possible between the adjacent wall panels or between the adjacent window panes. In particular, it has been desirable on the part of many architects to omit both vertical and horizontal exterior framing, furring members, mullions, or stanchions which were heretofore utilized along the horizontal and vertical joints of adjacent wall panels or window panes so as to aid in the securement of the exterior wall panels and the window panes to the frame of the building. A typical prior curtain wall construction which utilized exterior supports at the intersections of all of the exterior wall panels and window panes is illustrated in the above-mentioned prior U.S. Pat. No. 2,885,040.

However, since the exterior mullions, stanchions, or other framing members are desirably omitted on many modern building designs, there has been a problem in how to economically form the panels and the windows for the exterior walls of the building, to eliminate the stanchions or mullions, and yet to securely fasten the exterior wall panels and window panes to the frame of the building.

Still further, in many modern buildings which have a large glass window area, condensation and other moisture often builds up on the interior surfaces of the windows and collects at the bottoms thereof. As shown in U.S. Pat. No. 1,320,084, it was known to utilize a drain tube at the base of a large plate glass window in a store front so that condensation accumulating at the bottom, inner face of the window may be drained to the outside of the building below the windowsill. However, such a weep duct which exited directly to the outside face of the window immediately below the sill would break up the uniform appearance of the exterior panels of the building.

Additionally, since it is quite conventional in buildings of curtain wall construction to construct the exterior wall panels of metal sheeting with an insulative core therebetween, these metal panels will tend to expand and contract to a substantial degree relative to the building framework and relative to the glass windowpane when the exterior walls are subjected to varying temperature extremes, such as during extremely cold winter days or such as when exposed to direct sunlight. Also, in order to achieve an advantageous thermal efficiency for the walls of the building, it is important that the exterior walls of the building be effectively sealed against both water vapor and air exchange with the outside air.

SUMMARY OF THE INVENTION

Among the several objects and features of this invention will be noted a curtain wall construction for the exterior wall of a building in which exterior wall panels may be readily secured to the framework of the building with the wall panels in substantially side-to-side abutting relation without the requirement of stanchions or mullions viewable from the exterior of the building;

the provision of such a curtain wall construction in which window panes may be readily installed in window openings formed in the exterior walls of the building with the window panes being sealed relative to the exterior wall and with the exterior wall being movable in both horizontal and vertical direction relative to the window upon relative thermal expansion and contraction of the exterior wall panels and windowpanes;

the provision of such a curtain wall construction in which the window panes may be readily installed within the window openings of the exterior curtain walls and in which a substantial tolerance in the range of dimensions of the window opening may be readily accommodated by pre-sized window panes;

the provision of such a curtain wall construction system for a building which accommodates any dimensional thickness of the wall from the exterior face thereof to the inside face of the wall sheathing or drywall within a predetermined range of dimensions;

the provision of such a curtain wall construction system which condensation accumulating on the inside of the windows may be drained to the exterior of the building without the drain openings being visible from the exterior of the building;

the provision of such a curtain wall system which permits multiple window panes to be installed in a single window opening with the window panes being in side-to-side abutting sealed relation with one another without the requirement of mullions or other structural members viewable from the exterior of the building;

the provision of such a system which permits the window panes to move vertically and horizontally relative to the wall panels and to the window opening framing structure upon the wall panels and the window panes being exposed to varying temperatures without breaking the hermetic seal between the window panes and the window framing structure; and the provision of such a curtain wall construction and window framing system which is of economical and rugged construction, which is energy efficient, which is easy to install on a variety of building frame constructions, which readily accommodates a considerable variation in dimensional tolerances of the building frame construction, and which is relatively easy to field install.

Other objects and features of this invention will be in part apparent and thoroughly reviewed hereinafter.

Briefly stated, in an exterior curtain wall construction of a building, the building typically has an internal frame means with the exterior walls being secured to the building frame means and with the exterior walls having at least one window opening therein with an exterior curtain wall panel above and below the window opening. The window comprises at least one pane of glass, or the like, closing the window opening. The window opening is typically rectangular having a top, a bottom, and opposite vertical sides. More specifically, the improvement of this invention comprises upper means carried by the upper exterior wall panel above the window opening for securing the upper wall panel to the building frame. Lower means carried by the lower exterior wall panel below the window opening is provided for securing this lower exterior wall panel to the building frame. The above-mentioned upper and lower panel securing means each have an inwardly facing surface cooperable with the outer face of the upper and lower margins of the window pane when the latter is installed within the window opening thereby to prevent outward movement of the window pane with respect to the upper and lower securing means and to seal the window pane with respect to the upper and lower securing means. Still further, the lower securing means has an outwardly facing surface proximate the lower inner margin or face of the window pane, but spaced therefrom. A gasket is provided between the lower inner face of the window pane and the above-mentioned outwardly facing surface of the lower securement means thereby to sealingly hold the lower margin of the window pane captive between the inner and outwardly facing surfaces of the lower securing means. Still further, means is provided securable in place relative to the upper securement means on the inside of the window pane proximate the upper inner margin of the window pane with a gasket interposed between the upper inner margin of the window pane and the above-said securable means thereby to hold the upper margin of the window pane captive between the inner and outer facing surfaces of the upper securing means and the securable means.

BRIEF DESCRIPTION OF THE DRAWINGS

FIG. 3 is a vertical cross-sectional view taken along line 3—3 of FIG. 1 (on a larger scale than FIG. 1) illustrating details of the curtain wall system and window pane securement system of the present invention;

FIG. 3A is an enlarged view of an alternate embodiment of an extrusion constituting a portion of the window opening taken along line 3A—3A of FIG. 3;

Corresponding reference characters indicate corresponding parts throughout the several views of the drawings.

DESCRIPTION OF A PREFERRED EMBODIMENT

Figure 1:
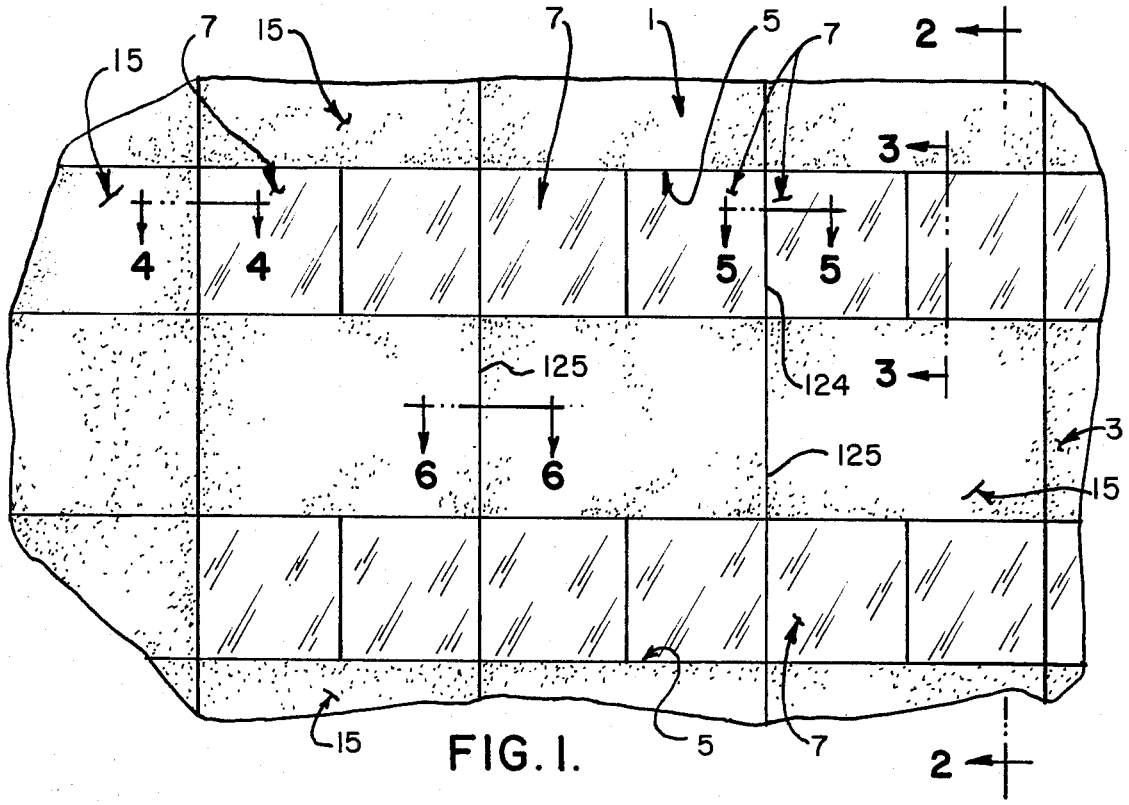
FIG. 1 is an elevational view of a portion of the exterior wall of a multiple floor building of curtain wall construction with the exterior wall including a plurality of exterior wall panels in side-to-side abutting relation defining a window opening therein with the window comprising one or more panes of glass installed within the window opening in accordance with the system of the present invention.
Figure 2:
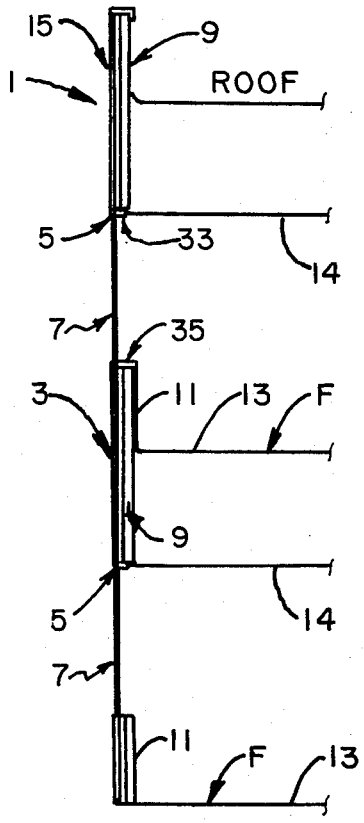
FIG. 2 is a vertical cross-sectional view taken along line 2—2 of FIG. 1 illustrating a multiple floor curtain wall construction system of the present invention and further illustrating the relation of the various floors, ceilings, and windows of the multiple floor building.

Referring now to the drawings, a building, as indicated in its entirety by reference character 1, is shown to have an exterior wall 3 of curtain wall construction in accordance with the present invention. Further, building 1 is shown to be a multiple floor building with each floor F of the building having a window opening, as generally indicated at 5, with the window opening being closed by one or more transparent window panes 7. As shown in FIG. 1, window opening 5 has a multiplicity of window panes 7 installed therein with the vertical adjacent sides of two adjoining window panes 7 being in side-to-side abutting relation, generally as shown in cross-section in FIG. 5 and as will be explained in detail hereinafter. As is typical, building 1 has a building frame 9, typically of steel or concrete beam construction, and the building wall is provided with an inner wall sheathing 11, such as drywall or the like, and, each floor level F has a floor 13 located generally below the bottom of window opening 5 and a ceiling 14 generally located at the top or above the window opening, as generally illustrated in FIG. 2.

Figure 4:
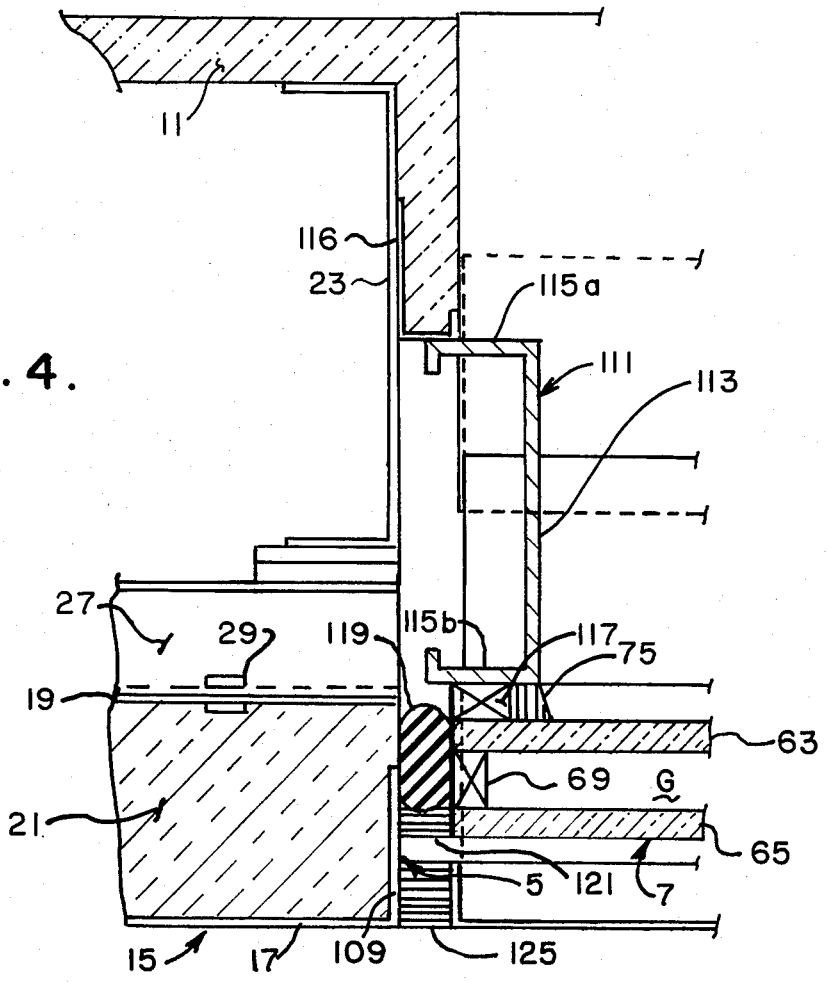
FIG. 4 is a horizontal cross-sectional view taken along line 4—4 of FIG. 1 on an enlarged scale illustrating the details of the curtain wall system and window mounting system of the present invention at the sides of the window opening, and particularly illustrating the details of construction at the sides of the window opening.

Referring now to FIGS. 3-4, the exterior wall 3 is comprised of a plurality of exterior wall panels, each of which is generally indicated at 15. Each of these exterior wall panels 15 comprises an outer sheet 17 of aluminum, fiber reinforced plastic, or other suitable sheet material, an inner sheet 19 with a thermal insulating core 21 interposed between the inner and outer sheets and adhesively bonded to the inner faces of the inner and outer sheets such that the exterior wall panel is of lightweight construction, is thermally efficient, is impervious to the weather, and such that the outer surface of outer sheet 17 may be finished in any number of desired colors or other finishes so as to provide a desired architectural, aesthetic effect for the building.

Figure 6:
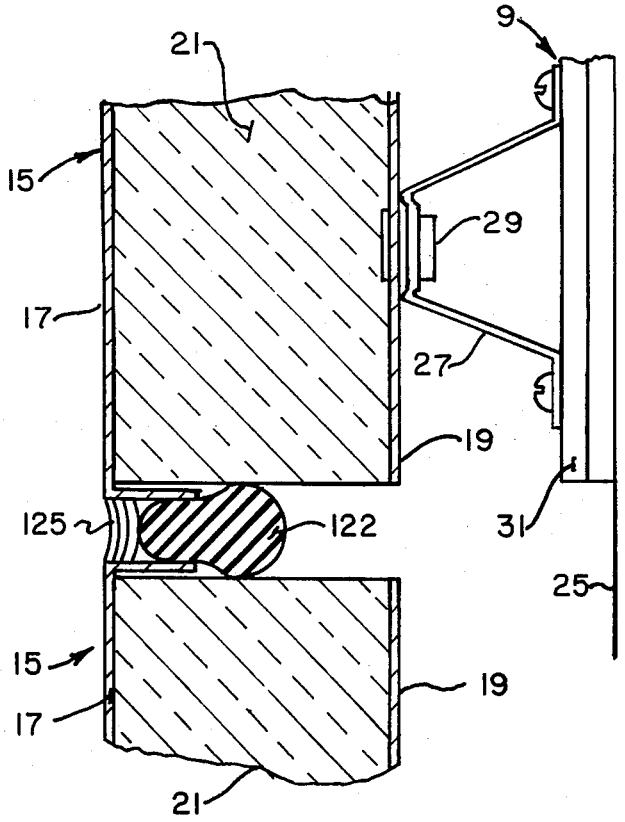
FIG. 6 is a horizontal cross-sectional view taken along line 6—6 of FIG. 1 on an enlarged scale illustrating the manner in which the exterior curtain wall panels are secured to the building framing and illustrating the manner in which adjacent exterior wall panels are sealed relative to one another in generally side-to-side abutting relation.

Building frame 9 further includes a plurality of wall studs, as indicated at 23, and furring strips 25, together with girts 27 carried by the studs and the furring strips constituting an exterior wall mounting frame for the building. As best shown in FIG. 6, suitable fasteners 29, such as so-called pop rivets or the like, may be utilized to secure exterior wall panels 15 to girts 27 in desired location on the exterior of the building. Shims 31 may be disposed between the girts 27 and studs 23 of the building, as required, so as to insure that the outer sheets 17 of various exterior panels 15 are generally coplanar with one another.

Figure 5:
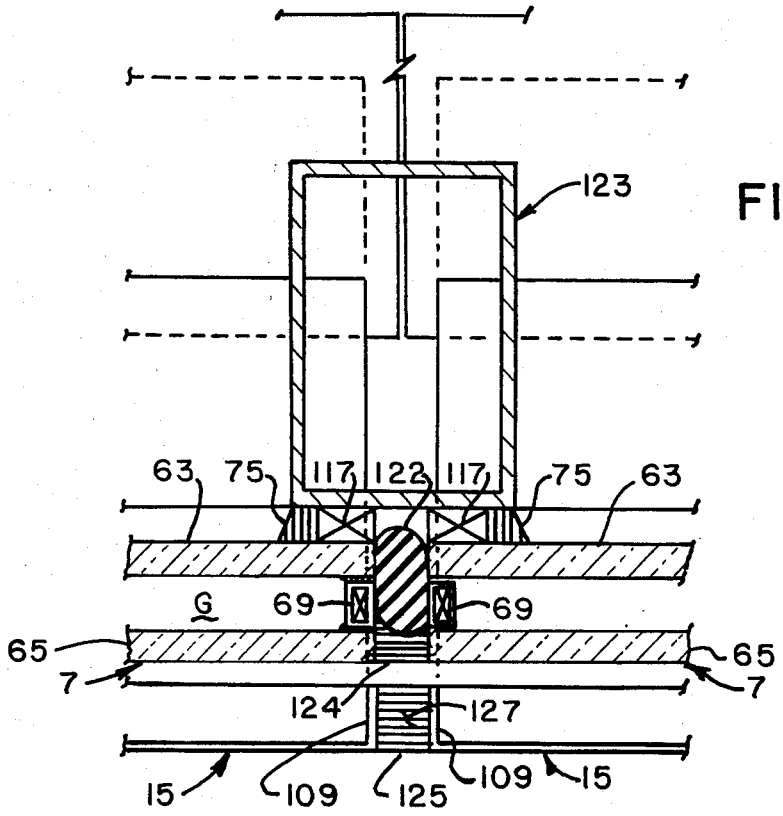
FIG. 5 is a horizontal cross-sectional view taken along line 5—5 of FIG. 1 in enlarged scale illustrating two adjacent window panes installed within the window opening of the curtain wall construction system of the present invention with the window panes in side-to-side abutting, sealed relation with a mullion installed on the inside of the window opening at the intersection of the window panes.

Referring now particularly to FIGS. 3–5, the curtain wall construction system of the present invention includes an upper window securement means, as generally indicated at 33, and a bottom window securement means, as generally indicated at 35. More specifically, each of the upper and lower window securement means is shown to comprise a complex extrusion E of aluminum or other suitable material which is adapted to receive respective bottom and top edges of exterior wall panels 15 so as to support the wall panels relative to the building frame and so as to define the upper and lower edges or surfaces of window opening 5. More particularly, the extrusions E for the upper and lower window securement means each includes an attachment portion, as indicated at 37, which is adapted to mate with a horizontal stud 23 extending lengthwise of window opening 5 above and below the window opening. As indicated at 39, a suitable shim (if required) may be interposed between attachment portion 37 of the upper and lower window securement means extrusion E so as to insure that the window opening is properly positioned relative to the building frame and so that the height of the window opening may be adjusted to be within a predetermined dimensional range. The upper and lower securement extrusions E are securely fastened to the upper and lower frame studs 23 by means of fasteners 41.

As previously mentioned, each of the upper and lower window securement means, 33 and 35, respectively, includes means, as generally indicated at 43, for receiving an exterior wall panel 15 and for securely fastening the exterior wall panel in its desired position relative to building frame 9 with the upper and lower surfaces constituting the window opening 5 in desired vertical spaced relation relative to one another. More specifically, this means 43 for receiving exterior panel 15 comprises a flange 45 extending vertically upwardly or downwardly from the main extrusion E of the upper or lower window securement means so as to engage the inner sheet 19 of exterior wall panel 15. A suitable fastener 47, such as a pop rivet or the like, may be utilized to securely fasten the exterior wall panel relative to flange 45. The upper and lower window securement means includes a so-called abutment leg 49 which extends outwardly beyond flange 47 and against which bears the end of core 21 of exterior panel 15. Further, the extrusion E for each of the upper and lower securement means 33 and 35 includes a vertically extending arm 51 which extends inwardly toward the window opening 5 and a finger 53 extending inwardly toward the building frame from the free end of respective arms 51 such that the abutment leg 49, arm 51, and finger 53 comprise a generally J-shaped hook arrangement. As indicated at 55, outer sheet 17 of exterior wall panel 15 extends beyond abutment leg 49 and is formed so as to extend inwardly, as indicated at 57. Further, the free end of the extension 55 and 57 of outer sheet 17 is formed in a hook shaped manner, as indicated at 59, so as to fit closely around arm 51 and finger 53 of the extrusion constituting the upper and lower window securement means. Preferably, the outer end of finger 53 of the extrusion has a bulbous end, as indicated at 61, so as to be engaged by the inner faces of the horizontal and vertical portions of the extension 55 of outer sheet 17 of the exterior wall panels. Thus, it will be appreciated that the vertical, inwardly facing surfaces of portions 59 of the extension of outer sheets 17 of the wall panels 15 are rigidly supported by the various portions of the extrusion of the upper and lower securement means and these inwardly facing surfaces constitute an abutment surface generally proximate to the outer face of the upper and lower margins of window pane 7. Further, the upwardly and downwardly facing horizontal surfaces of outer sheet portion 57 constitute the upper and lower surfaces of window opening 5.

Preferably, window panes 7 are double paned thermal windows having an inner glass pane 63 and an outer glass pane 65 spaced apart from one another by means of edge dams 67 sealably interposed between the inner and outer faces of the two window panes around the entire periphery of the window panes with the space between the window panes filled with a dry gas so as to increase the thermal insulative properties of window pane 7. The gap between the inner and outer window panes is generally indicated at G.

As shown best in FIG. 3, the weight of window pane 7 bears on a so-called bottom cushion 69 which in turn rests on the upper face of abutment leg 49 of the bottom window securement means. Additionally, an outer cushion 71 of suitable synthetic resin material or elastomeric material is provided between the upper, outer margin of the window pane and the inner face of arm 51 of the upper window securement means and between the lower bottom peripheral edge of the window and the inner face of arm 51 of the lower window securement means such that these outer cushions 71 transmit any outward pressure forces which may be exerted on window pane 7 (for example, when the air pressure within the exterior of the building is slightly above the air pressure on the exterior of the building) to securement extrusions E. Further, a formed-in-place seal, as indicated at 73, may be provided between the outer face of the outer window pane 65 and the abutment surface 59 of outer sheet 17 so as to hermetically seal the window pane relative to outer sheet 17. Preferably, these formed-in-place seals 73 are of a flexible, elastomeric caulking material, such as a silicone resin or the like, which will permit relative vertical movement between the window pane 7 and the upper and lower window securement means, such as may be occasioned upon the window pane and exterior wall 3 of the building being subjected to extreme changes in temperature, or such as when the wall is exposed to direct sunlight, or such as when the wall moves from direct, intense sunlight into the shade at different times of the day due to the different rates of thermal expansion of the glass window panes and the metal parts of the curtain wall.

Still further, on the inside of window pane 7, a spacer gasket, as indicated at 75, of suitable elastomeric material is installed against the upper, bottom, and side margins of the inner surface of inner window pane 63. As indicated at 77, a tenon is provided on the upper and lower window securement means and spacer gasket 75 is provided with a groove 79 which receives tenon 77 so as to positively hold the spacer gasket in position relative to the upper and lower window securement means.

Still further, in accordance with this invention, the upper window securement means 35 is provided with a window securement member 81 which may snapped-in-place relative to the main extrusion body E of the upper window securement means 33 after window pane 7 has been installed within window opening 5. More particularly, snap-in-place securement member 81 is shown to have a hook portion 83 which is received in a groove 85 provided in the main extrusion body of upper window securement means 33. Further, securement member 81 has a bottom face 87 which constitutes the upper, finished surface of the window frame within the interior of building 1. The snap-in-place securement member further has an upwardly facing surface 89 which has a securement clasp 91 on its upper or free end which resiliently snaps in place relative to an abutment surface 92 formed on the attachment portion 37 of the extrusion E for the upper window securement means 33. Thus, with hook 83 received in groove 85 of the extrusion, an upward blow to member 81 with a hammer, the heel of the hand or the like, causes the clasp 91 to snap into place.

Bottom window securement means 35 includes a sill portion 93 integral with the main extrusion E. Sill portion 93 has a finger 94 facing outwardly toward the bottom portion of window pane 7 and includes tenon 77 for receiving spacer gasket 75. Finger 94 thus serves as an abutment holding the lower, inner face of window pane 7 in its secured, sealed position relative to the window frame. The bottom window securement extrusion E further includes a stool 95 slidably adjustable relative to sill 93 toward and away from window pane 7. More particularly, stool 95 has a joggle 97 therein and a lower shelf 99 spaced below the level of sill 93 so that the upper surfaces of sill 93 and stool 95 constitute a window sill surface of adjustable depth so as to accommodate a variety of wall thicknesses of building 1 within a predetermined range of dimensions. The main extrusion E of bottom window securement means 35 has a vertical leg 101 extending up from attachment portion 37 at the inner end of the securement extrusion and the upper end of leg 101 constitutes a support for stool 95. The stood further includes a downwardly facing U-shaped clip, as indicated at 103, having inner and outer spaced supports 104*a*, 104*b* which receive drywall sheathing 11 constituting the inside wall sheathing for a room of building 1. It will be understood that with wall sheathing 11 secured to building frame 9, with the upper end of the wall sheathing secured in the U-shaped clip 103, with the bottom face of stool 95 bearing against the upper end of leg 101 and with shelf 99 positioned below sill 93, the stool is firmly anchored in position on the bottom window securement extrusion member. As shown in FIG. 3, the inner sheathing 11 for the inside wall of building 1 extends downwardly from ceiling 14 and may be formed to wrap around the header stud 23 of building frame 11 so as to mate with the inner face of the upper window securement means 33 in a manner well-known to those skilled in the drywall or wall sheathing art.

Referring further to FIG. 3, a so-called reservoir chamber 105 is provided within the bottom window securement means 35 adjacent a vertical leg 94 supporting sill 93 and the inner face of the window. It will be appreciated that condensation or other moisture which may form on the inside of the top window securement means, the side window securement means, and the bottom window securement means runs downwardly within respective spaces or voids provided in the aluminum extrusions E and collects in reservoir chamber 105. In accordance with this invention, a weep tube, as generally indicated at 107, is incorporated in exterior wall panels 15 such that the upper end of the weep tube is in communication with reservoir chamber 105 interiorily of the window pane 7 located thereon and such that the weep tube initially leads downwardly on the inside of the exterior wall panel 15. The weep tube is then fed through an opening (not shown) provided in the inner sheet 19 of the wall panel below the window opening 5, and is embedded within insulation core 21 and is proximate the outer sheet 17 adjacent the lower edge of the exterior wall panel. Further, the bottom end of tube 107 is in communication with an opening (also not shown) in the bottom surface 57 of the outer sheet 17 of the exterior panel so that moisture from the reservoir chamber 105 from the window located immediately thereabove may drain downwardly via weep tube 107 and be discharged downwardly on the exterior side of the window pane 7 therebelow from the above-mentioned opening within the horizontal surface 57 of the exterior panel. In this manner, accumulated moisture within the window securement framing may be drained to the exterior of the building and yet drain holes for the weep tube are not visible from the exterior or the interior of building 1.

Referring now to FIG. 4, the details of construction of the side frame of window opening 5 of the exterior curtain wall construction 3 of the present invention are illustrated in detail. At the lefthand side of FIG. 4, a horizontally extending girt 27 is secured (e.g., riveted or screwed) to a vertical stud 23 at the sides of the window opening and, via fasteners 29, exterior wall panels 15 are secured to the girts. The outer sheet 17 of exterior wall panel 15 has its end bent inwardly substantially perpendicularly to the outer face of the wall panel, as indicated at 109, so as to form a finished vertical side edge of window opening 5.

On the inside of window pane 7, a vertical side channel window frame, as generally indicated at 111, is provided which extends from window sill 93 above the snap-in-place upper securement member 81 of the upper window securement means 33. More specifically, this side frame member 111 is shown to be generally channel-shaped in cross-section having a web portion 113 constituting the side walls of the window frame and a pair of opposed channel legs 115*a*, 115*b* extending inwardly toward vertical wall stud 23. As indicated, inner wall sheathing 11 is formed to extend around the corner of vertical frame stud 23 and the outer edge of the window sheating is provided with a conventional retainer clip 116 which bears against the outer face of channel leg member 115*a*. Vertical channel side member 111 is anchored at its lower end to sill frame E (as shown in FIG. 3) with an aluminum angle (not shown) set within the channel and fastened with screws (also not shown) to the sill frame. The top end of the vertical channel window side member 111 is anchored to window head E in the same manner as the lower end. The top end of the vertical channel member side member is sized to be somewhat less (e.g., ⅜ inch or 1 cm.) than the full height of the window so as to permit vertical building and curtain wall expansion without compressing the jamb channel member. In this manner, the vertical channel window side frame member 111 is securely held in place at the side of the window opening.

Further as illustrated in FIG. 4, spacer gasket 75 is disposed between leg 115*b* of side frame channel 111 and the inner face of inner pane 63 of windowpane 7. Also, a suitable synthetic resin or elastomeric cushion 117 is disposed between the inner face of the window pane and the outer face of channel leg 115*b* such that the window pane is cushioned against inward movement relative to the side frame member 111 upon the air pressure on the outside of the window exceeding the air pressure on the inside of the window, such as when the window pane is subjected to high wind loading or the like. The spacer gasket 75 is preferably a field formed synthetic resin gasket that also serves as a structural retainer between leg 115*b* of side frame channel 111 and the inner face of the windowpane when the inner building pressure exceeds the exterior atmospheric pressure, such as when high wind velocities act on the building producing a high negative pressure. Still further, a suitable elastomeric vertical cushion 119 is provided between the finished end face 109 of wall panel 15 and the vertical side edges of window pane 7 so as to cushion the edges of the window pane relative to the edge of exterior panels 15 which constitute the vertical side surface of window opening 5. The vertical side edge of the window pane is sealed relative to exterior wall sheet end cap 109 by means of a formed-in-place seal 121 of a suitable elastomeric or other synthetic resin caulking material.

Referring now to FIG. 5, a horizontal cross section of a window constructed in accordance with this invention is illustrated in which the window comprises at least two co-planar, vertical adjacent window panes 7 which are generally in side-to-side relation within window opening 5. The adjacent vertical side edges of the adjacent window panes are spaced proximate to one another, but are separated by a gap equal to approximately one-half inch (or about 1.25 cm.) and have a suitable elastomeric cushion 122 extending vertically between the vertical side edges of the window panes 7. It will be appreciated that cushion 122 is shown in FIGS. 5 and 6 to be in a compressed position so as to seal against the sides of adjacent windows 7 (FIG. 5) or against adjacent panels 15 (FIG. 6) and to accomodate expansion and contraction. Thus, cushion 122 serves as an expanding and contracting gasket seal.

On the inside of the window panes centered on the joint between the adjacent windowpanes, a vertical mullion, as indicated generally by reference character 123, is securely fastened to window sill 93 and to upper window securement means 33 so as to support the abutting inner edges of the adjacent window panes 7 thereby to hermetically seal the window panes relative to the interior of the building, and so as to positively support the abutting edges of the window panes 7 against pressure loading exerted on the outside of the window panes such as may be experienced during a windstorm or the like. Preferably, mullion 123 is cut to be somewhat shorter than the length of the spacing between window sill 93 and the upper window securement means 33 so as to permit curtain wall thermal expansion for structural deflection movement when the inner building pressure exceeds the exterior atmospheric pressure such as when high winds act on the building producing a high negative pressure. However, in accordance with this invention, the vertical side edges of the window appear to be substantially in edge-to-edge abutting relationship when viewed from the exterior of the building thus yielding a substantially uninterrupted plane of glass within window opening 5 even though multiple panes are used.

More specifically, synthetic resin or elastomeric cushion blocks 117 are interposed between the inner faces of the inner window panes 63 and the adjacent face of the box section mullion 123 so as to support the inner vertical edges of the window panes against inward movement. Further, spacer gaskets 75 are interposed between the interface of the mullions and the inner face of the inner window panes 63 to aid in sealing the window panes. More particularly, spacer gaskets 75 are formed-in-place and comprise a structural synthetic resin adhesive which is interposed between the outer face of mullion 123 and the inner face of windowpane 63 so as to support the windowpanes against inward movement under positive wind loading conditions and thereby to resist the outward movement of the windowpanes under negative wind load pressures. On the exterior of cushion 122, a formed-in-place caulking seal 124 is provided.

Further, as shown in FIG. 5, generally in vertical register with the side-to-side abutting joint between adjacent window panes 7, a typical vertical side-to-side abutting exterior wall panel joint, as generally indicated at 125, is shown, spaced exteriorly of the plane of the outer surface of outer panes 65 of the side-to-side adjacent window panes 7. This typical exterior wall panel joint 125 is defined by a gap between the end caps 109 of the adjacent exterior panels 15. A formed-in-place seal of suitable elastomeric caulking material 127 is provided within the gap so as to positively seal the gap between the vertical edges of the substantially side-to-side abutting exterior panels. A similar such panel joint 125 is illustrated in FIG. 4 generally in register with formed-in-place seal 121 for sealing between the outer vertical edge of the window pane 7 and the end cap 109 defining the side edges of window opening 5.

In accordance with the above-stated objects and features of the present invention, it will be seen (FIG. 1) that the exterior ,panels 15, which constitute a major portion of the exterior surfaces of exterior wall 3 of the building 1 of the present invention, may be readily installed on building frame 9 such that the exterior sheeting faces 17 of the exterior wall panels are generally coplanar with one another in a vertical plane and such that vertical stanchions and horizontal ribbing members normally required to cover the horizontal and vertical joints between the adjacent exterior wall panels are omitted thus leaving a relatively clean exterior wall surface with only the formed-in-place panel caulking seals 127 visible from the exterior of the window. Further, it will be seen that the window securing means 33 and 35 of the present invention are adjustable in width-wise (thickness) direction so as to accomodate exterior wall thicknesses of the building through a reasonable predetermined range of wall thicknesses. Still further, it will be appreciated that with the upper and lower window securement means 33, 35 installed in place in the manner generally heretofore described, the window panes 7 may be inserted within the window opening 5 from the inside of the building by first inserting the bottom edge of the window pane into reservoir chamber 105 and then rotating the window pane upwardly into its vertical, installed position such that the upper and lower margins of the outer window pane 65 are in substantial abutting relation with cushions 71 which serve to vertically locate the window pane relative to legs 51 of the upper and lower securement main extrusions E. Then, with spacer gasket 75 positioned around the outer margins of the inner face of the inner window pane 63, the snap-in-place window securement member 81 is snapped in place on the upper window securement frame means 33 thereby to positively lock the window pane in place within the upper and lower window securement means. Still further, it will be appreciated that the bottom window sill is adjustable in width-wise direction between the inner face of window pane 7 and the plane of the vertical wall sheathing 11 constituting the inner faces of the building walls.

In FIG. 3, it will be noted that a substantial space is provided above the top edge of window pane 7. Because the window pane is sealably secured relative to surfaces 59 of the outer sheet 17 of exterior wall panel 15 by means of formed-in-place elastomeric gaskets 73, a substantial amount of relative movement between window pane 7 and exterior wall panels 15 defining window opening 5 may be accomodated, such as may be occasioned during a rather drastic change in temperature of the windowpane and of the exterior wall panels, such as upon the building being suddenly radiated by direct sunlight on a summer day and then suddenly moving into the shade. Because the thermal expansion characteristcs of the metal sheet 17 of the exterior panels 15 is quite different from the thermal expansion characteristics of the glass window panes 7, these differential rates of thermal expansion may be readily accomodated by the construction system and method for the curtain walls of the present invention without breaking the hermetic seals 73 and 121 between the outer surface of the windowpanes and the exterior wall panels.

Referring now to FIG. 3A, an alternate embodiment of the upper extrusion E is indicated in its entirety by reference character E'. It will be understood that corresponding parts of extrusion E' having a similar construction and function to the portions of extrusion E heretofore described, are indicated by "primed" reference characters. It will be particularly noted that immediately below abuttment leg 49', a cavity C is provided in extrusion E'. Cavity C has an opening 201 and has a major cavity portion 203 and side portions 205 with the main cavity portions and the side portions being delimited by inwardly projecting shoulders 207.

After extrusion E' has been extruded, cavity C is filled with a suitable poured-in-place synthetic resin material, such as epoxy or the like, and the resin material is allowed to harden in place. It will be particularly noted that the hardened-in-place resin fills both the main cavity portions 203 and the side cavity portions 205, and is mechanically interlocked within the cavity C by means of the inwardly projecting shoulders 207. Then, after the epoxy filler within cavity C is hardened, a portion of abuttment leg 49', as indicated at 209, is machined away, as by milling, along the entire length of the extrusion (or alternately at spaced intervals leaving small bridges of metal interconnecting the opposite portions of abuttment leg 49'). In this manner, the epoxy filler within cavity C rigidly connects the inner and outer portions of extrusion E' maintaining the structural rigidity of the extrusion, but the formed-in-place synthetic resin forms a thermal barrier TB, thus preventing the excess thermal conduction of heat from the inner surfaces of extrusion E' (i.e., the righthand portions of the extrusion shown in FIG. 3A) and the outer surfaces of the extrusion which may be exposed to extreme cold ambient air temperatures. In this manner, conductive heat loses through the aluminum extrusion E' are minimized and condensation or frost formation on the inner surfaces of the extrusion is effectively prevented.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. In an exterior wall of a building of curtain wall construction, the building having an internal frame means, the exterior wall being secured to said building frame means, and having at least one window opening therein with an exterior wall panel above and below said window opening, said window opening having at least one pane of glass or the like therein closing said window opening, said window opening further having a top, a bottom, and sides, wherein the improvement comprises: upper means at the top of said window opening for securing said upper wall panel to said building frame means, lower means at the bottom of said window opening for securing said lower exterior wall panel to said building frame means, said upper and lower panel securing means each having an inwardly facing surface cooperable with the outer face of the upper and lower margins of the said window pane when the latter is installed within said window opening thereby to prevent outward movement of said window pane with respect to said upper and lower securing means and to seal said window pane with respect to said upper and lower securing means, said lower securing means having an outwardly facing surface proximate the lower, inner face of said window pane but spaced inwardly therefrom, a gasket between said lower, inner face of said window pane and said outwardly facing surface of said lower securement means thereby to sealingly hold the lower margin of said window pane captive between the inner and outwardly facing surfaces of said lower securing means, means securable in place relative to said upper securement means on the inside of the window pane proximate the upper, inner margin of said window pane, a gasket interposed between said upper inner margin of said window pane and said securable means thereby to hold the upper margin of the window pane captive between the inner and outer facing surfaces of said upper securing means via the securable means, said curtain wall construction incorporating outer building panels, said outer building panels each comprising an outer sheet, an inner sheet, and a core of insulating material secured to the inner sheet, and a core of insulating material secured to the inner faces of said inner and outer sheets, said outer sheet being so formed that portions thereof define the upper and lower surfaces of said window opening with the said outer sheets being bent inwardly toward said building and then vertically so as to constitute said inwardly facing surfaces cooperable with the outer, upper and lower margins of said window pane.

2. In a building as set forth in claim 1 wherein said upper and lower securing means include portions thereof which reinforce said outer sheet in the portions thereof which constitute said inwardly facing surfaces.

3. In a building as set forth in claim 2 wherein said upper and lower securing means each have a vertical outer portion in close proximity to the inner face of said outer sheet of said exterior wall panels extending out beyond the core of said wall panels, a cushion of compressible material disposed between the outer face of said window pane at the top and bottom margins thereof and the inner faces of said outer vertical portions of said upper and lower securement means thereby to transfer at least a portion of the pressure loading from said window pane to said securing means in the event air pressure within said building exceeds the air pressure on the outside of the building.

4. In an exterior wall of a building of curtain wall construction, the building having an internal frame means, the exterior wall being secured to said building frame means and having at least one window opening therein with an exterior wall panel above and below said window opening, said window opening having at least one pane of glass or the like therein closing said window opening, said window opening further having a top, a bottom, and sides, wherein the improvement comprises: upper means at the top of said window opening for securing said upper wall panel to said building frame means, lower means at the bottom of said window opening for securing said lower exterior wall panel to said building frame means, said upper and lower panel securing means each having an inwardly facing surface cooperable with the outer face of the upper and lower margins of said window pane when the latter is installed within said window opening thereby to prevent outward movement of said window pane with respect to said upper and lower securing means and to seal said window pane with respect to said upper and lower securing means, said lower securing means having an outwardly facing surface proximate the lower, inner face of said window pane but spaced inwardly therefrom, a gasket between said lower, inner face of said window pane and said outwardly facing surface of said lower securement means thereby to sealingly hold the lower margin of said window pane captive between the inner and outwardly facing surfaces of said lower securing means, means securable in place relative to said upper securement means on the inside of the window pane proximate the upper, inner margin of said window pane, a gasket interposed between said upper inner margin of said window pane and said securable means thereby to hold the upper margin of the window pane captive between the inner and outer facing surfaces of said upper securing means via the securable means, said outer building panels each comprise an outer sheet, an inner sheet, and a core of insulating material secured to the inner faces of said inner and outer sheets, said outer sheet being so formed in the portions thereof defining the upper and lower surfaces of said window opening such that said outer sheet is bent inwardly toward said building and then vertically so as to constitute said inwardly facing surfaces cooperable with said window pane, one side portion of said window opening being such that the outer sheet of one of said exterior building panels is bent inwardly and so that it extends inwardly towards the building beyond the outer surface of said window pane, a cushion disposed between said side edge of said window pane and the surface of said portion of the outer sheet of the last-said exterior panel bent inwardly at the sides of said window opening, and formed-in-place seal means between said portion of said outer sheet constituting the side of said window opening and said window pane thereby to seal said window pane with respect to said window opening.

5. In an exterior wall as set forth in claim 4 wherein said upper or lower securing means includes a unitary extrusion of heat conductive metal or the like, said extrusion having an outer portion exposed to outside ambient air conditions and an inner portion with a bridge integrally connecting said outer and said inner portions, said bridge having an elongate cavity therein, said cavity being filled with a formed-in-place synthetic resin thermal barrier, at least portions of said bridge proximate said cavity being removed after the installation of said synthetic resin thermal barrier whereby said synthetic resin thermal barrier structurally interconnects said inner and outer portions of said extrusion and effectively minimizes the thermal conduction of heat between said inner and outer portions.

6. The invention of claims 1 or 4 and further comprising said lower securement means further including means disposed below said window pane on the inside thereof for the collection of moisture within said lower securement means, and for draining said moisture to the outside of the building, said discharge means being a weep tube leading downwardly from the lower securing means internally of the upper window to the upper securement means of the lower window therebelow and extending exteriorly of the window pane of the lower window, and said weep tube extending through the wall panel arranged between said upper and lower windows.

7. The invention of claims 1 or 4, and further comprising said exterior wall including an inner wall sheathing constituting the wall of a room within the building with the distance from said window pane to said sheathing varying within a predetermined range, and including a spacing means provided between the room wall and the window pane and further comprising a flat, horizontal surface constituting a sill for said window, said sill having a first portion adjacent to and stationary with respect to said window pane and a movable portion movable towards and away from said stationary portion to form the window sill surfaces of the window of varying depths depending on the distance said inner wall sheathing is spaced from said window pane, and said movable portion including a stool having a joggle therein and being shiftable with respect to said sill for accommodating the said variable thickness sheathing.

8. In a building as set forth in claim 7 wherein said movable portion has means for receiving the top edge of said sheathing below said window opening.

* * * * *